US006514118B1

(12) United States Patent
Bart et al.

(10) Patent No.: US 6,514,118 B1
(45) Date of Patent: Feb. 4, 2003

(54) TOY STUFFED ANIMAL HAVING CONVERTIBLE CONFIGURATIONS

(76) Inventors: Philip D. Bart, 4261 W. McNab Rd., Apt. No. 19, Pompano Beach, FL (US) 33069; David Murray, 4818 Arnold Palmer Ct., North Fort Myers, FL (US) 33903

( * ) Notice: Subject to any disclaimer, the term of this patent is extended or adjusted under 35 U.S.C. 154(b) by 9 days.

(21) Appl. No.: 09/696,825

(22) Filed: Oct. 25, 2000

(51) Int. Cl.[7] ..... A63H 3/12
(52) U.S. Cl. ..... 446/321; 446/297
(58) Field of Search ..... 446/321, 72, 71, 446/76, 369, 337, 297, 368, 371, 385, 391, 487; 434/133, 137, 156

(56) References Cited

U.S. PATENT DOCUMENTS

| | | | | |
|---|---|---|---|---|
| 1,583,284 A | | 5/1926 | Dykman | |
| 1,695,264 A | | 12/1928 | Adams | |
| 2,195,127 A | | 3/1940 | Brucker | |
| 2,811,807 A | | 11/1957 | Swann | |
| 2,823,490 A | | 2/1958 | Griem | |
| 3,195,265 A | | 7/1965 | Marquez | |
| 3,755,960 A | * | 9/1973 | Tepper et al. | |
| 3,851,419 A | | 12/1974 | Kaelin | |
| 4,336,665 A | * | 6/1982 | Moreau | |
| 4,413,442 A | | 11/1983 | McSweeney | |
| 4,547,171 A | | 10/1985 | Horimoto | |
| 4,639,233 A | | 1/1987 | Brassfield | |
| 4,695,264 A | * | 9/1987 | McLeod, Jr. | 446/321 |
| 4,734,938 A | | 4/1988 | Anderson | |
| 4,781,648 A | * | 11/1988 | Garfinkel | 446/321 |
| 4,889,512 A | | 12/1989 | Burnett | |
| 5,046,986 A | * | 9/1991 | Wood et al. | 446/321 |
| 5,090,938 A | | 2/1992 | Reynolds | |
| 5,224,894 A | | 7/1993 | Nelson | |
| 5,376,038 A | * | 12/1994 | Arad et al. | 446/297 |
| 5,458,932 A | | 10/1995 | Zinbarg | |
| 5,638,561 A | | 6/1997 | Sperry | |
| 5,649,848 A | * | 7/1997 | Clark | 446/321 |
| 5,791,963 A | | 8/1998 | Lieberman | |
| 5,944,533 A | * | 8/1999 | Wood | 434/322 |
| 6,106,358 A | * | 8/2000 | McKenzie | 446/299 |

FOREIGN PATENT DOCUMENTS

WO 0211843 A1 * 2/2002

* cited by examiner

*Primary Examiner*—Derris H. Banks
*Assistant Examiner*—Jamila Williams
(74) *Attorney, Agent, or Firm*—Malin, Haley & DiMaggio, P.A.

(57) ABSTRACT

A stuffed animal toy for children that emulates the awakening of the stuffed animal upon the user touching one of various locations upon the body of the stuffed animal thereby activating an appropriate pre-recorded audio message. The stuffed animal also includes a second head portion such as a Santa Claus-like head portion mounted within a recess behind the original teddy bear head portion that can be easily converted manually by a child from a first position representing the original teddy bear configuration, to a second position, representing a second configuration such as a Santa Claus head configuration for holiday seasons. Upon the manual exchange of the head portions of the stuffed animal, a switch is activated which enables a pre-recorded audio message to play through a speaker located within the stuffed animal. The audio message played corresponds to the head portion which appears on the stuffed animal after the exchange. Other reversible features like reversible hands, paws, or legs can be included as well as a rear flap, which when reversed and fastened, represents a coat or other garment corresponding to the appearance of the bear after its transformation.

4 Claims, 7 Drawing Sheets

FIG. 2
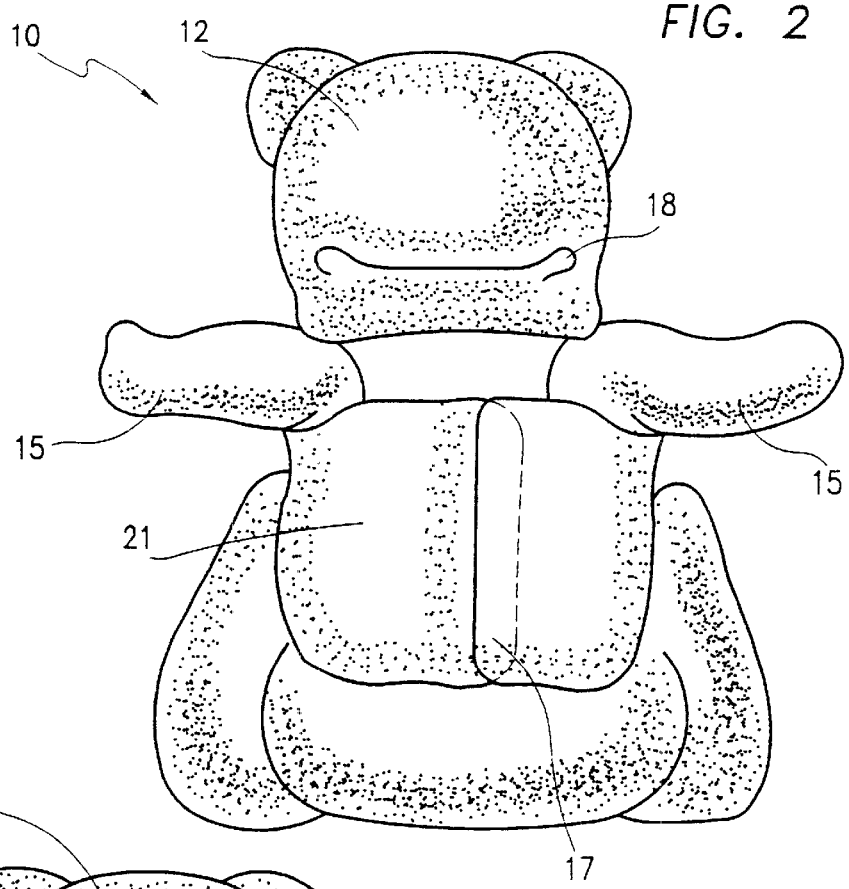
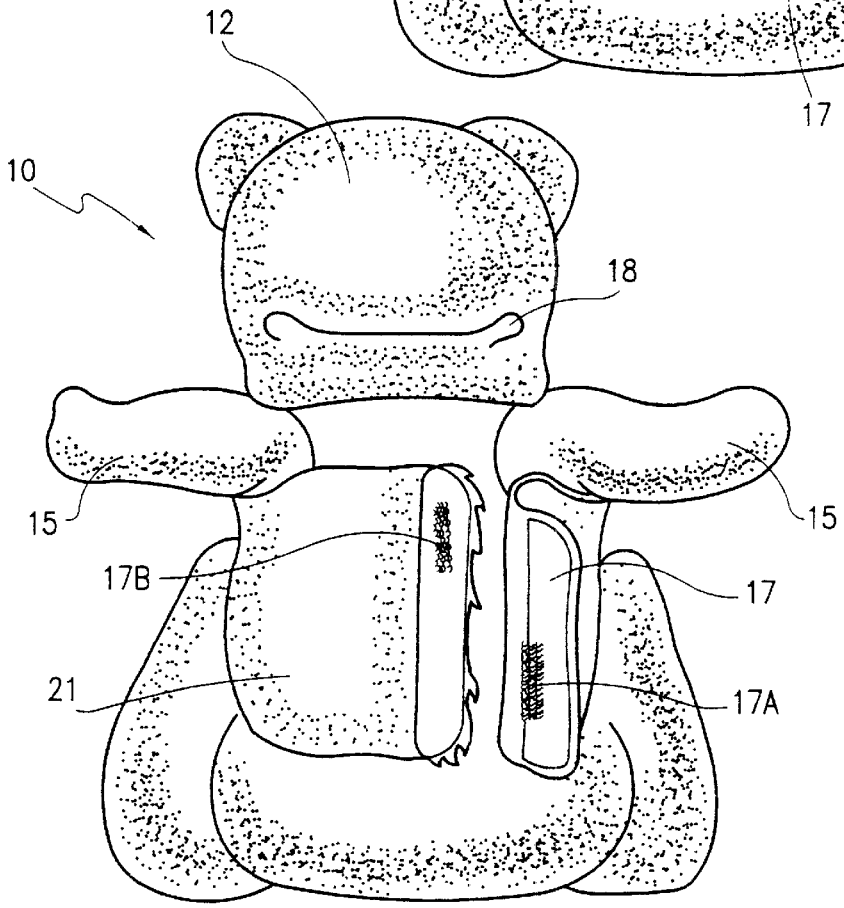
FIG. 3

TOY STUFFED ANIMAL HAVING CONVERTIBLE CONFIGURATIONS

BACKGROUND OF THE INVENTION

1. Field of the Invention

This invention relates to toys and in general to stuffed animals such as teddy bears, and specifically to a toy stuffed animal having a first appearance or configuration that speaks when certain portions of the stuffed animal's body is pressed and that can also be convertible into a stuffed animal having a second appearance or configuration that also speaks but whose speech now corresponds to the second configuration. The stuffed animal includes a second head portion which is exchanged for the original head, and may also include reversible paws or feet, and a reversible flap which, upon the transformation of the stuffed animal to its second configuration, can be reversed to turn into a coat, diaper, or other garment, to represent the second configuration. The second configuration of the stuffed animal may be for particular festive occasions such as holidays, although it is not limited to holidays and can be converted into virtually any configuration.

2. Description of Related Art

This invention relates to a toy such as a teddy bear that an be converted or altered into different configurations. U.S. Pat. No. 5,090,938 issued to Reynolds, Feb. 25, 1992, shows a toy or other object alterable between two different shapes.

U.S. Pat. No. 4,547,171 issued to Horimoto, Oct. 15, 1985, shows a stuffed toy that includes an illumination device for illuminating portions of the toy.

U.S. Pat. No. 5,458,932 issued to Zimbarg, Oct. 17, 1995, shows a Santa Claus-like decorative object that includes a combination of a flexible bag member and has a Santa Claus shape.

Although there are a variety of toys that provide some transition, it is important to have a toy that can be converted into a different appearance or configuration and which has the capability of playing different, distinct audio messages for each configuration.

The present invention provides a stuffed animal such as a teddy bear that includes an electrical contact switch and that upon touching the teddy bear, an audio message will be activated simulating the awakening of the teddy bear. The teddy bear includes several convertible features, one of which is the head of the teddy bear, which upon rotation, converts to a second head and face. The second head and face is hidden within a recess of the original teddy bear head. Other convertible features include bear's paws or other parts of the body that allows the child to substitute the teddy bear face, paws, and other features, with a second face, or a second set of paws or feet to complete the transformation into a second configuration corresponding to another holiday personage such as a teddy bear with a Santa Claus, beard, and red coat, so that in the alternate mode of operation, the teddy bear can also provide a Santa Claus or other festive holiday figure.

BRIEF SUMMARY OF THE INVENTION

A toy stuffed animal that includes a plurality of two-positionable body parts and elements that can have a first position corresponding to a teddy bear configuration and a second position corresponding to a second configuration, different from the first configuration.

Upon movement of the bear's arms or upon pressure applied to a pre-determined location on the bear's body, a plurality of switches are activated. The switches could be an impact switch, or could be based on merely the touching of the fingers to certain areas of the body, which itself forms the contact for activating an electrical circuit. When the circuit is activated, an audio message will play for a predetermined length of time. The audio message corresponds to the initial configuration of the stuffed animal, for example, a teddy bear.

The stuffed body includes a second and face configuration that is mounted reversibly within a recess behind the stuffed animal's head, the second head and face representing a festive holiday figure, such as a Santa Claus face with a Santa Claus hat and beard.

The stuffed animal may also include other reversible features, such as reversible paws, feet, or other body features like a tail. Each reversible body feature has a second corresponding body feature hidden within a recess underneath the first body feature. Once all of the hidden body features have been reversed, a complete transformation has taken place and a second, new stuffed animal representation appears wherein all of the reversed body features correspond with the second head configuration.

In one example, the stuffed animal would be a teddy bear, and the alternate or convertible figure face would be a teddy bear head with a Santa Claus hat and perhaps a Santa Claus beard to give it the appearance of Santa Claus.

The teddy bear capable of being converted to a Santa Claus configuration comprising a body having a plurality of arms and legs stuffed with a polyester fiberfill or equivalent material to provide a configuration of an animal having a first appearance, such as a teddy bear, a first head portion representing the appearance of a teddy bear, two arms, two legs, two feet, and two paws.

A second head portion having a second appearance distinct from the first appearance is mounted within a first recess situated proximate the rear of the original teddy bear head and is moveable from a first position within the recess to a second position outside of the original teddy bear head while, at the same time, the original teddy bear head is moved within a second recess formed underneath the second head portion whereby the resultant alternative configured toy has a second appearance, such as a Santa Claus configuration, distinct from said first appearance.

Mounted within the teddy bear are means for activating an audio message signifying the awakening of the teddy bear wherein the means can be an activation switch located within the teddy bear proximate the mid-section of the teddy bear wherein upon the lifting of the teddy bear, the switch activates the awakening message to be played through a speaker located within the body of the teddy bear toy.

Also mounted within the teddy bear is a conversion switch which activates a second audio message corresponding to the Santa Claus appearance wherein the conversion switch is located within the teddy bear proximate the neck of the teddy bear whereupon the forward rotation of the teddy bear head and conversion from the teddy bear configuration to the Santa Claus configuration and appearance of the Santa Claus head activates the second audio message corresponding to the second appearance.

The conversion switch mounted within said teddy bear also activates a first audio message corresponding to the teddy bear's first appearance whereupon the backward rotation of the Santa Claus head and conversion from the Santa Claus configuration back to the teddy bear configuration, the conversion switch activates the first audio message corresponding to said first appearance.

In an alternate embodiment, the conversion switch activates a third, "fail-safe" audio message upon the forward rotation of the teddy bear head prior to the awakening of the teddy bear. The third audio message notifies the user that the teddy bear must first be "awakened" prior to the transforming of the teddy bear configuration into the Santa Claus configuration.

Finally, a reversible flap is situated proximate the mid-section of the teddy bear body, and affixed at the back of the teddy bear via standard hook and loop fastening means such as VELCRO®. The flap can be reversed and fastened around the front mid-section portion of the body to represent, for example, a red Santa Claus coat. Additionally, the bear's paws also contain material capable of being reversed to reveal previously-hidden material corresponding to the Santa Claus coat and head.

The original teddy bear head can be pushed inside a second recess created when the second or alternative Santa Claus face is rotated in place thereby displacing the original teddy bear face and head.

Thus, to utilize and play with the toy, a child seeing the teddy bear lying in a sleeping mode, physically applies contact to or pick-ups the teddy bear, at which time, the teddy bear will respond as if it is being awakened by emitting an audio message and sounds. The child can then manually rotate the head of the teddy bear, forward, which displaces the original teddy bear head and face, and converts the teddy bear into a second face having the appearance of a Santa Claus-like teddy bear for the Christmas season. The original teddy bear's head is now completely hidden as it resides within a recess underneath the Santa Claus-like head. The child can then continue the transformation by reversing different body parts such as the bear's paws, feet, and reversing the flap behind the bear to reveal a red Santa Claus coat. As the head portion of the teddy bear is being converted to a second configuration, a second, audio message will play, corresponding to the second configuration of the stuffed animal.

A third audio message will play if the user first flips the teddy bear's head forward to reveal the second head configuration, without first "awakening" the bear by pressing its body. This message will remind the user to first "awaken" the bear, and then transform it by reversing its head and other body parts.

Other holiday characters could be emulated by the secondary figuration such as the Easter bunny at Easter, a New Year's Baby, or appropriate Thanksgiving characters for Thanksgiving holidays. For example, the New Year's baby may include similar reversible flaps, as in the Santa Claus bear, but instead, upon reversal of the flaps, a diaper is formed around the bear's bottom portion. Although holiday characters are typically represented, any figures or characters may be represented.

It is an object of this invention to provide an improved convertible toy stuffed animal.

It is still another object of this invention is to provide an improved stuffed animal that can have two configurations or appearances representing two distinct characters having different appearances wherein a child can manually transform the animal from a first to a second configuration by reversing several individual body parts.

It is still yet another object of this invention to provide a convertible stuffed animal or toy that can play an audio message unique to an initial configuration and appearance and a second, distinct audio message unique to the second, converted configuration and appearance wherein the second audio message is played upon the conversion from the initial configuration to the second, converted configuration.

In accordance with these and other objects which will become apparent hereinafter, the instant invention will now be described with particular reference to the accompanying drawings.

BRIEF DESCRIPTION OF THE SEVERAL VIEWS OF THE DRAWINGS

FIG. 2 shows a back view of the teddy bear in accordance with the present invention.

FIG. 3 shows a back view of the teddy bear with VELCRO® flaps separated to initiate the initial transformation of the teddy bear from a first configuration to a second configuration.

PREFERRED EMBODIMENT OF THE INVENTION

Figure 1:
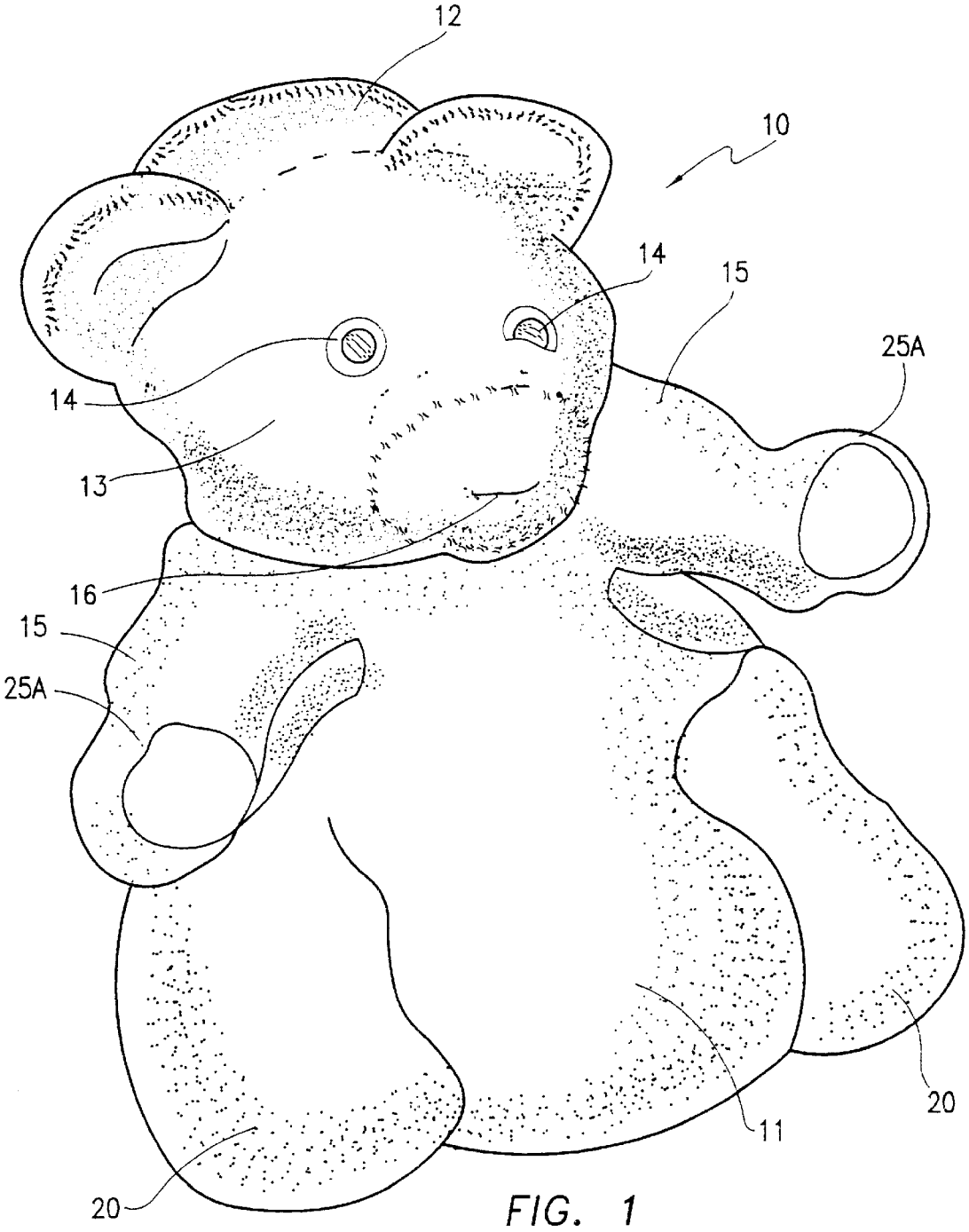
FIG. 1 shows a front perspective view of the teddy bear representing the first configuration of the stuffed animal in accordance with the present invention.

FIG. 1 shows a stuffed animal in accordance with the present invention that is in the configuration of a teddy bear 10 that includes a stuffed animal body 11 having a pair of arms 15 and legs 20 covered with a fabric and containing a stuffed material to emulate a teddy bear. The teddy bear 10 also includes a head 12, face 13, eyes 14, and paws 25A.

In the preferred embodiment, upon the touching of the bear's body, arms, or other pre-determined body part, a pre-recorded audio message, stored on a memory device within the bear will play, simulating the awakening of teddy bear 10.

FIG. 2 shows a back view of teddy bear 10. This view shows a flap 17 which is shown in a closed position. VELCRO® can be used to keep flap 17 in a closed position although any standard hook and latch fastening means would suffice. Upon transformation of the teddy bear 10 into a second configuration, the flap 17 can be manually released from its closed position and the material 21 which is wrapped around the bear and secured by the VELCRO® can be swung forward, thereby exposing the material's reverse side. This reverse side encircles the body of the bear when the bear has been transformed into a second configuration. For example, material 21 may have a red material underneath representing the coat for a Santa Claus configuration. Material 21 can be seen in its reversed state, in FIG. 7, clearly representing a Santa Claus coat 21B, wrapped around the body of the teddy bear.

FIG. 3 shows flap 17 with a VELCRO® strip 17A, being opened. The VELCRO® strip 17A adheres to a corresponding VELCRO® strip 17B, thereby securing flap 17. The releasing of the flap 17 is one of the steps of the transformation of the teddy bear 10 into a different, second configuration.

FIGS. 2 and 3 also show the outline of recess 18 situated at the lower rear portion of head 12 of teddy bear 10. It is within this recess 18 that material which will form the head portion representing the teddy bear in a second configuration is contained.

Figure 4:
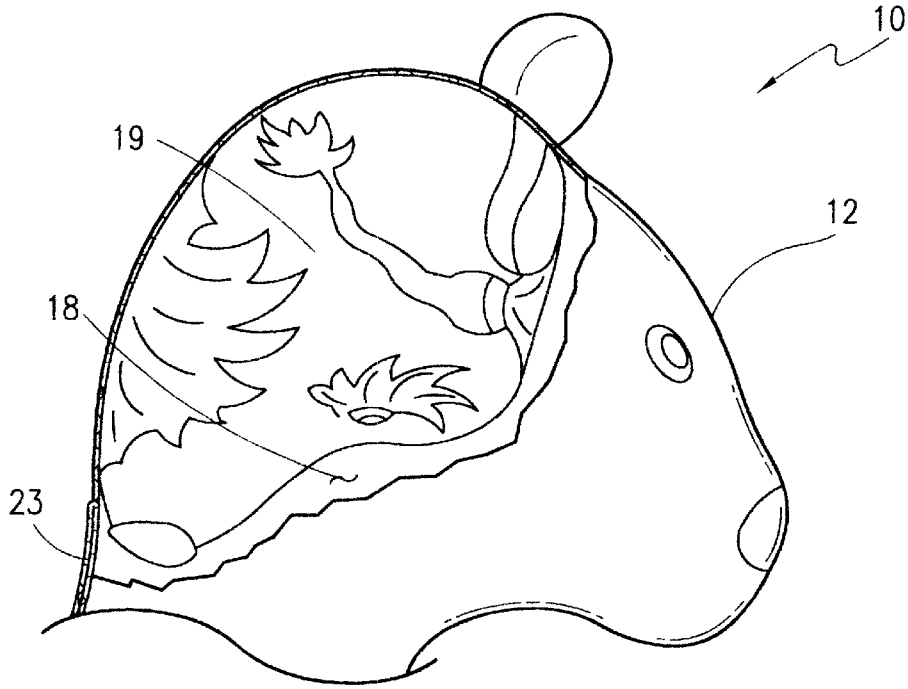
FIG. 4 shows a side view of the teddy bear beginning its transformation from a first configuration to a second configuration, representing, for example, a Santa Claus-like head, face and features.

FIG. 4 shows a cut-away view of the teddy bear head 12, with a second head 19 residing within recess 18. Stitched portion 23 represents the common portion of teddy bear head 12 and second head 19.

Figure 4A:
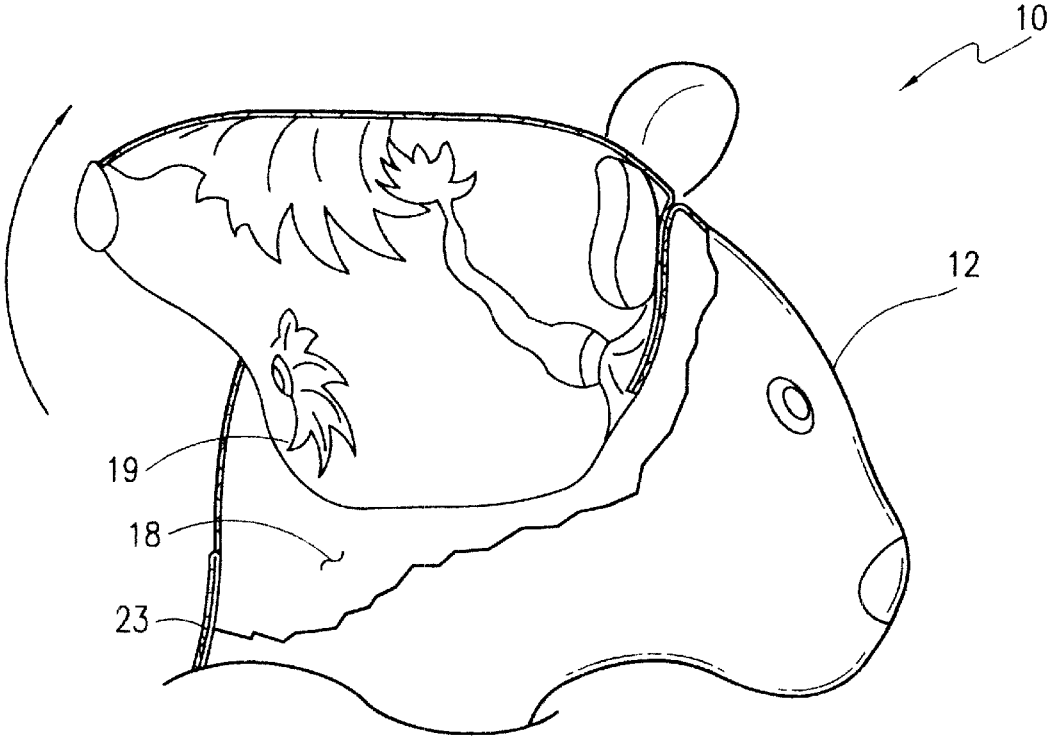
Figure 5:
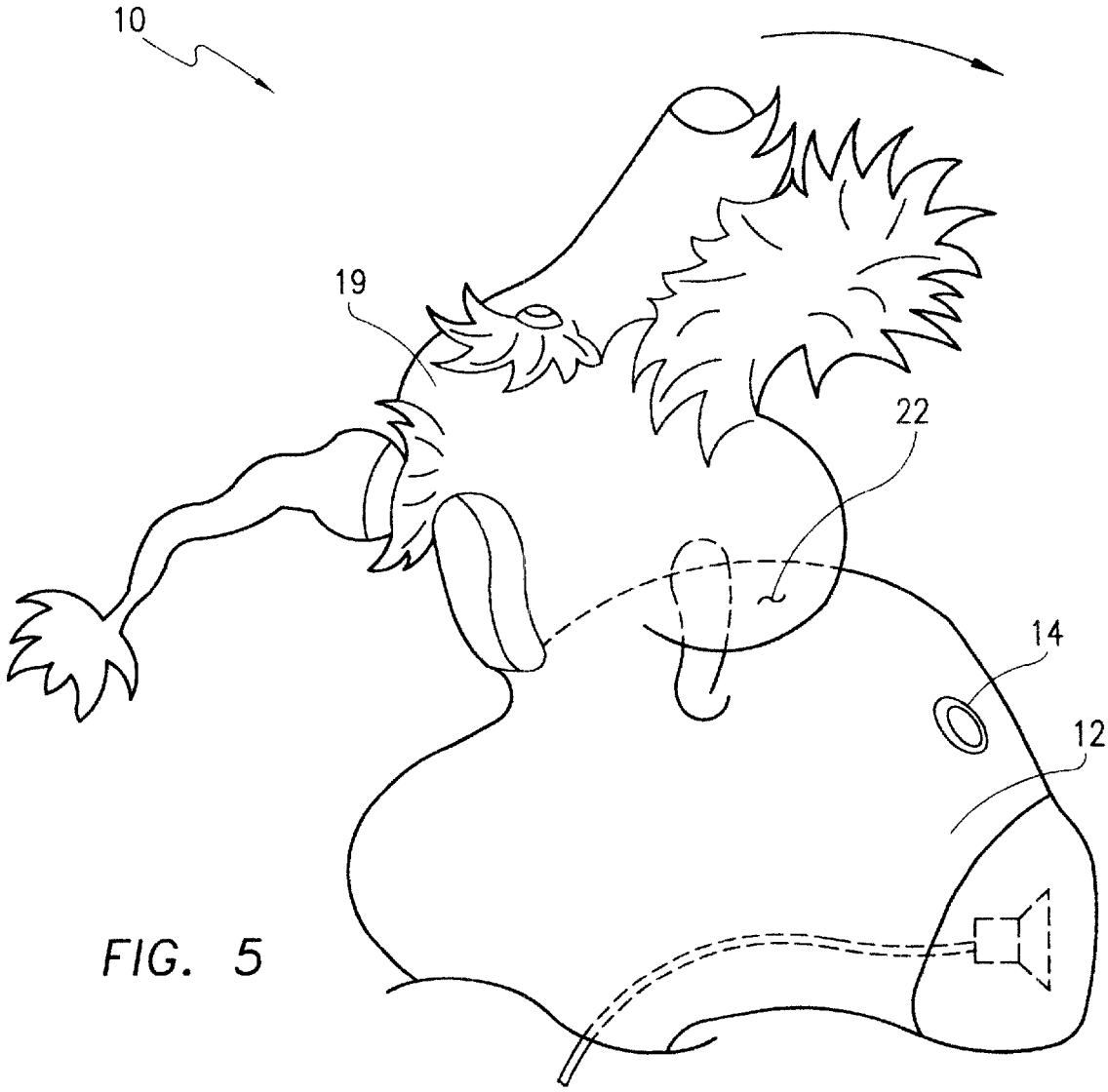
FIG. 5 shows a side view of the teddy bear further in the process of transforming from a first configuration to a second configuration such as a Santa Claus face.
Figure 6:
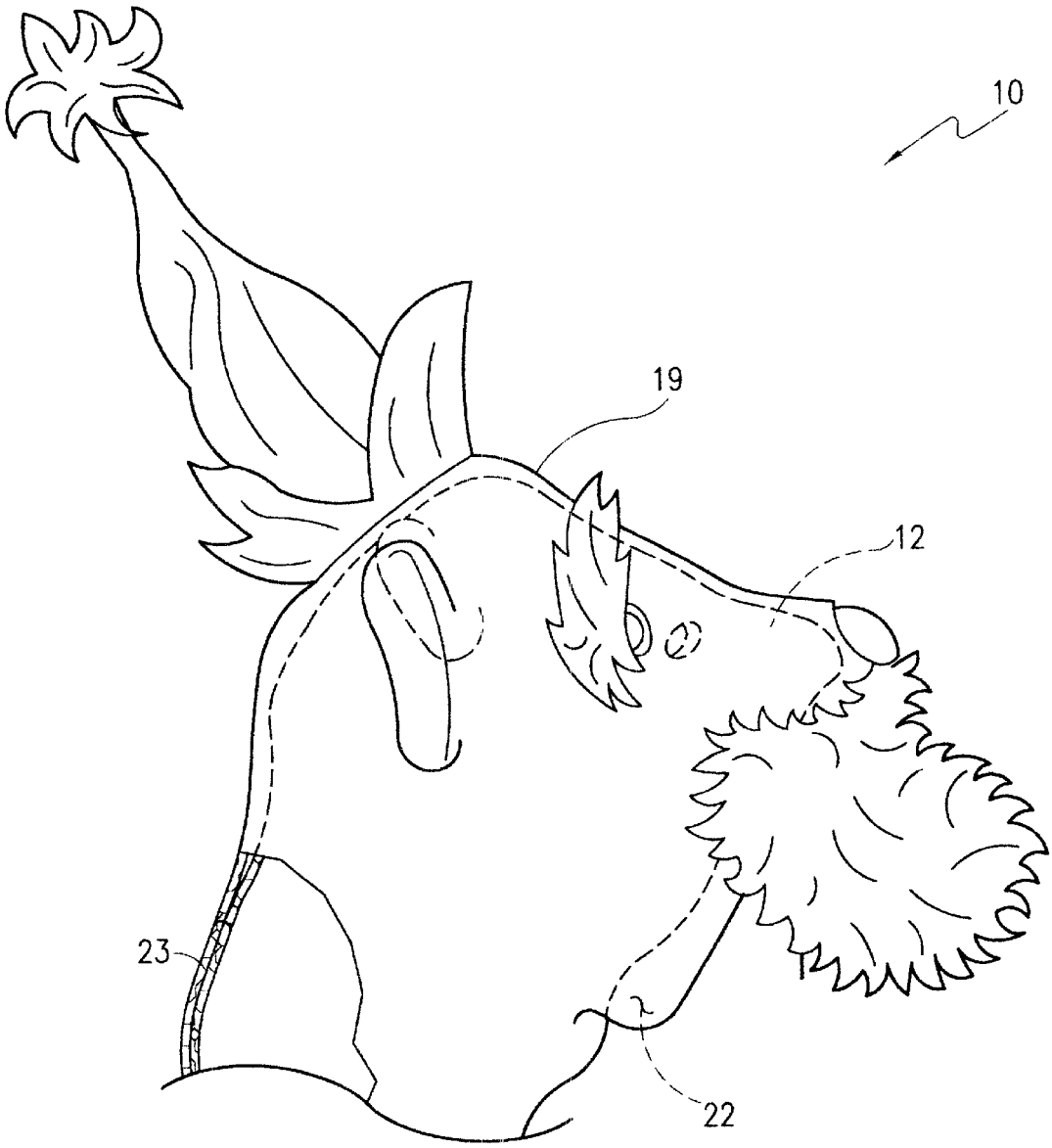
FIG. 6 shows a side view of the present invention after transformation to a second configuration has been completed.

FIG. 4A shows the beginning of the transformation process whereby teddy bear 10 can be converted into a second character, for example, a figure representing a specific holiday, such as Christmas, by allowing a second or inside head 19 having, for example a Santa Claus face, hat and beard, to be released from its position inside recess 18 and rotated forward into position while the original bear head 12 itself retracts within a second recess 22 underneath the second head 19 of the stuffed animal, as shown in FIGS. 5 and 6. It would therefore be easy for a child to manually reverse the positions of the head 12 to replace the teddy bear head with that of another head representing a second character such as Santa Claus.

FIG. 5 shows the transformation from a first configuration to a second configuration, at a later time than as shown in FIGS. 4 and 4A. In this figure, the Santa Claus head portion 19 has been released from within recess 18 and is being swung forward and above the teddy bear head portion 12. As the Santa Claus head portion circles above, the teddy bear head portion 12 becomes enclosed within a second recess 22 created when the Santa Claus head completes its circular path. FIG. 5 shows both the teddy bear head portion 12 and Santa Claus head portion 19, just prior to Santa Claus head portion 19 enveloping teddy bear head portion 12. The configuration shown in FIG. 5 allows the teddy bear 10 to take on another appearance, i.e. one that is a combination of teddy bear head 12 and second head 19. Recess 22 is located underneath second head 19. Head 12 resides within this recess after transformation is complete, as shown in FIG. 6.

Figure 8:
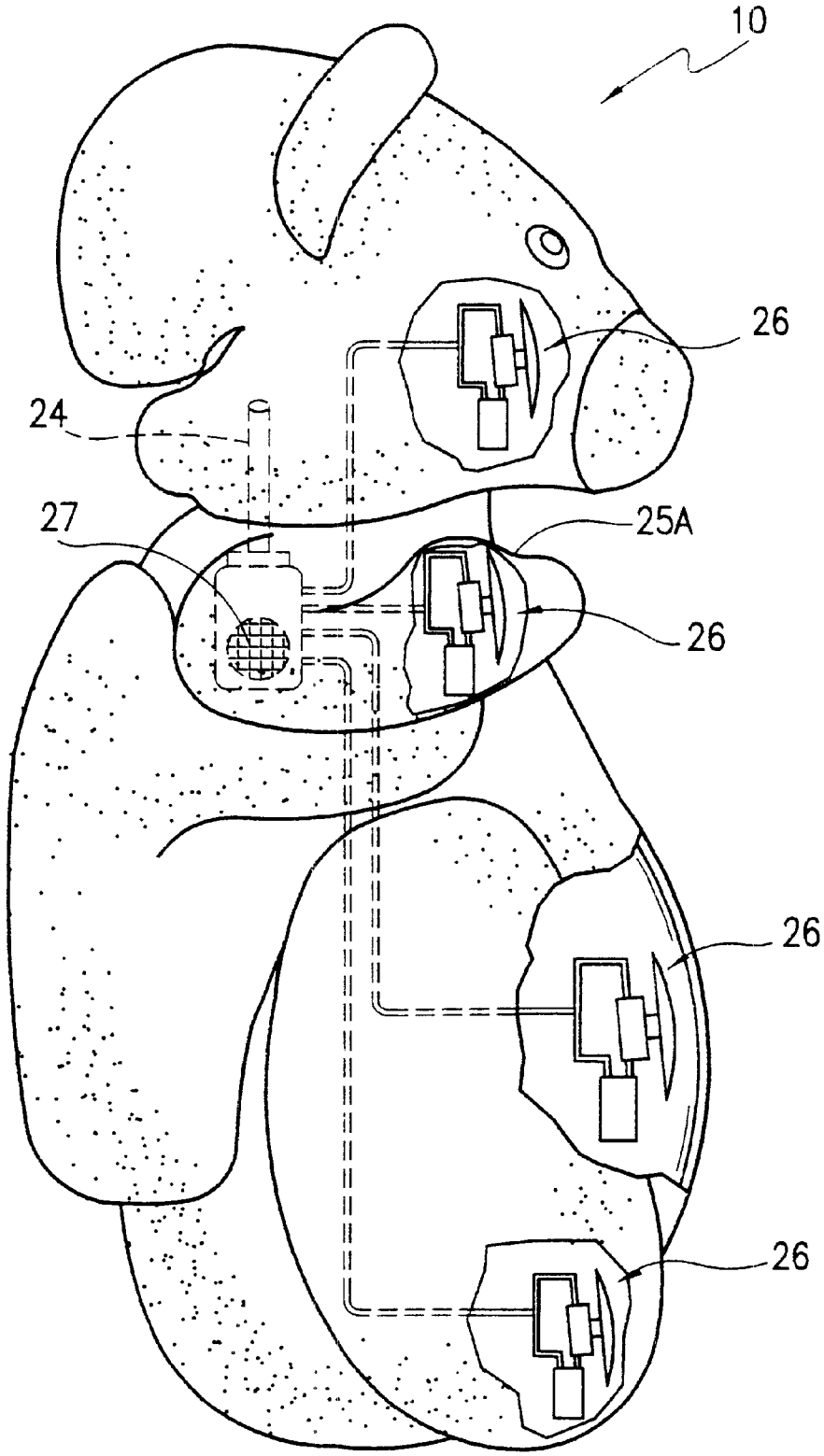
FIG. 8 shows a cut-away side view of the teddy bear of the present invention showing the locations of impact switches and associated electronics for transforming teddy bear from a sleeping mode to an awakened mode.

In an alternate configuration, a computer chip containing an audio message can be activated upon the moving of the bear's limbs or pressure applied to a pre-determined body location. As seen in FIG. 8, a series of contact switches and associated circuitry 26 may reside in the bear's stomach portion, legs, paws, or head. A particular audio message will be played when the bear is in its original appearance and configuration and one of the plurality of switches is activated. The audio message represents the awakening of the stuffed animal toy or doll. Upon the rotation of the Santa Claus head portion 19 and its subsequent rotation forward to take the place of the original teddy bear head and face, a conversion device 24 is activated, closing an electrical circuit thereby activating a distinct audio message which corresponds to the Santa Claus-like face which now appears. Device 24 can be seen clearly in FIG. 8 residing within the teddy bear, proximate its head and neck. This allows the device to be activated upon the forward, or backward rotation of the head. When the second head 19 is rotated backwards, device 24 once again is activated, and a different pre-recorded audio message is played, this time corresponding to the original teddy bear configuration. If a user rotates the teddy bear head portion forward first, without first pressing the teddy bear body to "awaken" the bear, a third, "fail-safe" message will play, telling the user that the bear must first be "awakened" and then transformed into its second appearance in order to activate the audio message corresponding to the bear's second appearance.

FIG. 6 shows a side view of the Santa Claus head portion 19 after transformation has been completed. The original teddy portion head 12 is shown via dashed lines, to be concealed within the second recess underneath the Santa Claus head portion 19.

Figure 7:
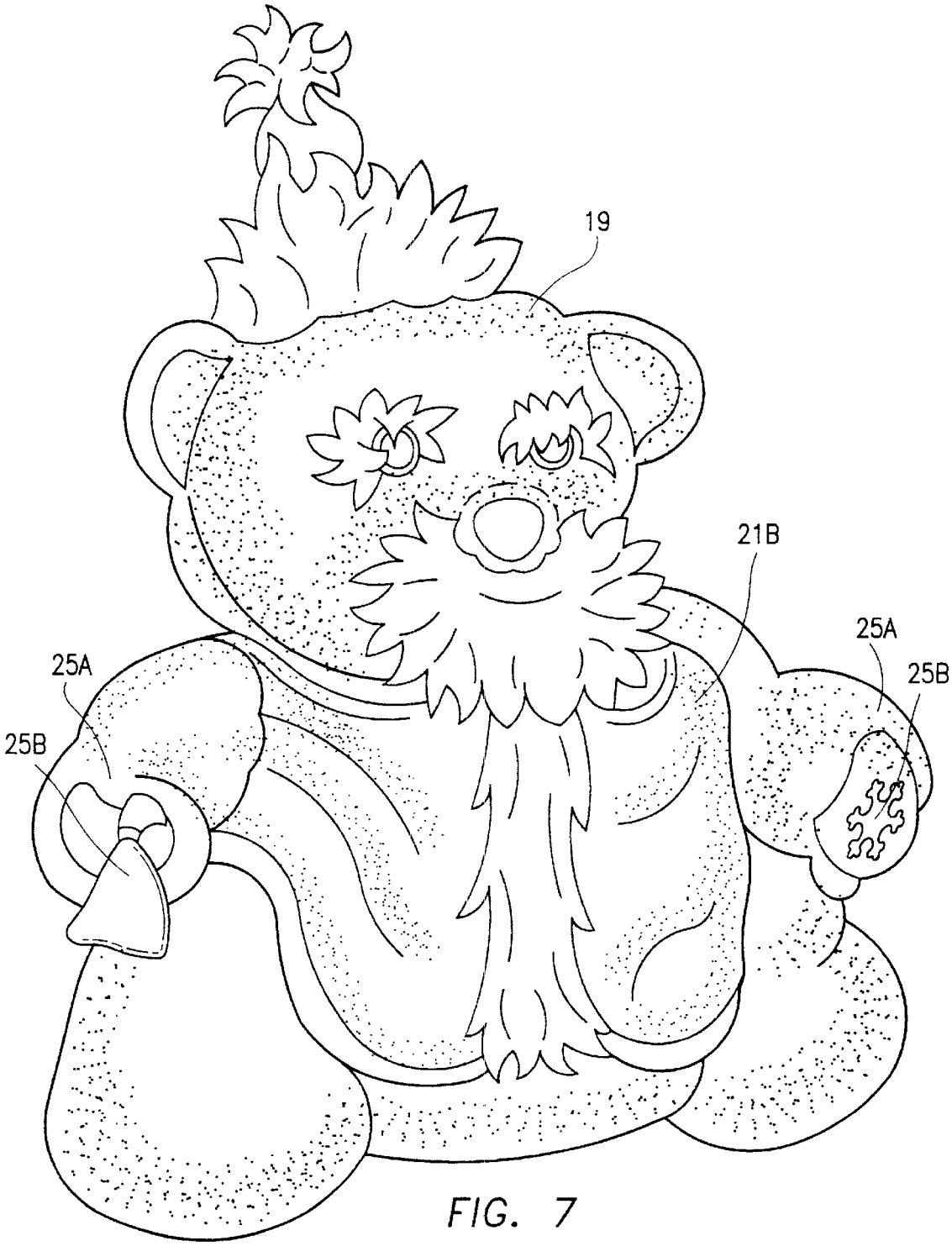
FIG. 7 shows a front perspective view of the teddy bear of the present invention after transformation to a second configuration has been completed.

FIG. 7 shows the stuffed animal after transformation into the Santa Claus character. In addition to the manual rotation of the original teddy bear head forward, the rear flap 17, as shown in FIGS. 2 and 3 can be manually released and reversed to allow material 21B representing an outer garment corresponding to the second head configuration, for example a red overcoat for the Santa Claus configuration, to be wrapped around the body of the stuffed animal. FIG. 7 shows the complete transformation including the Santa Claus coat material 21B covering the body of the stuffed animal. The material representing each side of the coat 21B, can be secured, via VELCRO® or any conventional hook and loop fastening means. FIG. 7 also shows paws 25B, which are revealed to display material previously hidden by paws 25A, of FIG. 1. Paws 25B are comprised of material which are manually exposed to reveal material corresponding with reversed coat 21B and reversed head portion 19.

The present invention is not limited to reversible paws or coats, but can encompass virtually any body part or piece of clothing.

FIG. 8 represents a side view of the teddy bear 10 in a cut-away view showing several possible locations of the awakening means. Upon pressure applied to the stomach portion, legs, paws, or front head portion of the stuffed animal, an impact switch and associated circuitry 26 can be activated, causing the awakening message to play. FIG. 8 also shows the conversion device 24 located within the stuffed animal, proximate the head or neck portion of the stuffed animal. Device 24 may be a simple switch, or, in an alternate embodiment, a magnet may be utilized in lieu of a switch. Upon the exchanging of the original teddy bear head with the head representing the second configuration, or vice versa, the switch or magnet is activated, and the appropriate audio message is played through speaker 27.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A convertible stuffed animal toy comprising:

a body including a head portion having an exterior face and an interior face, said interior face initially concealed within a recess situated proximate said head portion, said head portion's exterior face portraying a first appearance, said interior face portraying a second appearance distinct from said first appearance, said head portion being moveable from a first position wherein said exterior face is displayed, to a second position wherein said interior face is displayed, by forward rotation of said head portion wherein after said forward rotation said exterior face is concealed beneath said interior face thereby resulting in the stuffed animal toy having the second appearance distinct from the first appearance, said body used for both the first appearance and the second appearance of the stuffed animal toy;

a plurality of limbs;

means mounted within said body for activating a message signifying awakening of said stuffed animal toy wherein said means comprises an activation switch located at a pre-determined location within said stuffed animal toy;

means mounted within said stuffed animal toy for activating a first audio message corresponding to said stuffed animal toy's first appearance;

means mounted within said stuffed animal toy for activating a second audio message corresponding to said stuffed animal toy's second appearance;

means mounted within said stuffed animal toy for activating a third audio message; and said pre-determined location within said stuffed animal toy is proximate a mid-portion of said body wherein upon pressure applied to said mid-portion, said activation switch activates said message when said stuffed animal toy is showing said first appearance.

2. A convertible stuffed animal toy comprising;

a body including a head portion having an exterior face and an interior face, said interior face initially concealed within a recess situated proximate said head portion, said head portion's exterior face portraying a first appearance, said interior face portraying a second appearance distinct from said first appearance, said head portion being moveable from a first position wherein said exterior face is displayed, to a second position wherein said interior face is displayed, by forward rotation of said head portion wherein after said forward rotation said exterior face is concealed beneath said interior face thereby resulting in the stuffed animal toy having the second appearance distinct from the first appearance, said body used for both the first appearance and the second appearance of the stuffed animal toy;

a plurality of limbs;

means mounted within said body for activating a message signifying awakening of said stuffed animal toy wherein said means comprises an activation switch located at a pre-determined location within said stuffed animal toy;

means mounted within said stuffed animal toy for activating a first audio message corresponding to said stuffed animal toy's first appearance;

means mounted within said stuffed animal toy for activating a second audio message corresponding to said stuffed animal toy's second appearance;

means mounted within said stuffed animal toy for activating a third audio message; and said means for activating said second audio message comprises a conversion switch located within said stuffed animal toy proximate the head portion of said stuffed animal toy whereupon the forward rotation of said head portion and conversion from said first appearance to said second appearance, said conversion switch activated said second audio message corresponding to said second appearance.

3. A convertible stuffed animal toy comprising:

a body including a head portion having an exterior face and an interior face, said interior face initially concealed within a recess situated proximate said head portion, said head portion's exterior face portraying a first appearance, said interior face portraying a second appearance distinct from said first appearance, said head portion being moveable from a first position wherein said exterior face is displayed, to a second position wherein said interior face is displayed, by forward rotation of said head portion wherein after said forward rotation said exterior face is concealed beneath said interior face thereby resulting in the stuffed animal toy having the second appearance distinct from the first appearance, said body used for both the first appearance and the second appearance of the stuffed animal toy;

a plurality of limbs;

means mounted within said body for activating a message signifying awakening of said stuffed animal toy wherein said means comprises an activation switch located at a pre-determined location within said stuffed animal toy;

means mounted within said stuffed animal toy for activating a first audio message corresponding to said stuffed animal toy's first appearance;

means mounted within said stuffed animal toy for activating a second audio message corresponding to said stuffed animal toy's second appearance;

means mounted within said stuffed animal toy for activating a third audio message; and said means for activating a first audio message comprises a conversion switch located within said stuffed animal toy proximate the head portion of said stuffed animal toy wherein upon backward rotation of said head portion and conversion from said second appearance to said first appearance, said conversion switch activates said first audio message corresponding to said first appearance.

4. A convertible stuffed animal toy comprising:

a body including a head portion having an exterior face and an interior face, said interior face initially concealed within a recess situated proximate said head portion, said head portion's exterior face portraying a first appearance, said interior face portraying a second appearance distinct from said first appearance, said head portion being moveable from a first position wherein said exterior face is displayed, to a second position wherein said interior face is displayed, by forward rotation of said head portion wherein after said forward rotation said exterior face is concealed beneath said interior face thereby resulting in the stuffed animal toy having the second appearance distinct from the first appearance, said body used for both the first appearance and the second appearance of the stuffed animal toy;

a plurality of limbs;

means mounted within said body for activating a message signifying awakening of said stuffed animal toy wherein said means comprises an activation switch located at a pre-determined location within said stuffed animal toy;

means mounted within said stuffed animal toy for activating a first audio message corresponding to said stuffed animal toy's first appearance;

means mounted within said stuffed animal toy for activating a second audio message corresponding to said stuffed animal toy's second appearance;

means mounted within said stuffed animal toy for activating a third audio message; and said means for activating said third audio message comprises a conversion switch located within said stuffed animal toy proximate the head portion of said stuffed animal toy whereupon the forward rotation of said head portion to said awakening of said stuffed animal toy, said conversion switch activates said third audio message notifying a user to awaken said stuffed animal toy prior to the forward rotation of said head portion.

* * * * *